US006526893B2

(12) United States Patent
May et al.

(10) Patent No.: US 6,526,893 B2
(45) Date of Patent: Mar. 4, 2003

(54) POLYMER BALLISTIC TIP PELLETS

(76) Inventors: Thomas R. May, 14654 CR 162, Nathrop, CO (US) 81236; Lee T. Phillips, P.O. Box 417, Hartsel, CO (US) 80449

( * ) Notice: Subject to any disclaimer, the term of this patent is extended or adjusted under 35 U.S.C. 154(b) by 0 days.

(21) Appl. No.: 09/770,816

(22) Filed: Jan. 26, 2001

(65) Prior Publication Data

US 2002/0100389 A1 Aug. 1, 2002

Related U.S. Application Data

(60) Provisional application No. 60/179,140, filed on Jan. 31, 2000.

(51) Int. Cl.[7] ..... F42B 12/34
(52) U.S. Cl. ..... 102/508; 102/517; 102/518
(58) Field of Search ..... 102/501, 507–510, 102/514–519

(56) References Cited

U.S. PATENT DOCUMENTS

| | | | | | |
|---|---|---|---|---|---|
| 3,941,059 | A | * | 3/1976 | Cobb | 102/510 |
| 4,005,660 | A | | 2/1977 | Pichard | |
| 4,245,557 | A | * | 1/1981 | Knappworst et al. | 102/517 |
| 4,251,079 | A | | 2/1981 | Earl et al. | |
| 5,150,909 | A | | 9/1992 | Fitzwater | |
| 5,471,719 | A | | 12/1995 | Sawyers | |
| 5,728,349 | A | | 3/1998 | Persson | |
| 6,244,186 | B1 | * | 6/2001 | Pichard | 102/508 |

FOREIGN PATENT DOCUMENTS

| | | | | |
|---|---|---|---|---|
| CA | 990136 | * | 6/1976 | 102/501 |
| DE | 191181 | * | 1/1907 | 102/507 |
| EP | 359946 | * | 3/1990 | 102/501 |
| GB | 2269654 | * | 2/1994 | 102/517 |
| GB | 2279440 | * | 1/1995 | 102/501 |
| RU | 1808115 | * | 4/1993 | 102/517 |
| RU | 2000539 | * | 9/1993 | 102/501 |

* cited by examiner

*Primary Examiner*—Harold J. Tudor
(74) *Attorney, Agent, or Firm*—Theresa M. Seal, Esq.

(57) ABSTRACT

Soft lead pellets with hard polymeric tips for use in air guns and the like are disclosed. The lead pellets have forward pointed tip portions made from a hard polymeric material. Tip portions are employed in three different configurations including a hollow and solid heads. The hard tip in each of the pellets enables the pellet when fired from an air gun to pierce the fur and skin of small game animals, for example, before the lead portions of the head and skirt portions begin to deform, imparting shock to the surrounding soft tissue, and shattering bone. The disclosed pellets provide both accuracy due to the ballistic tip, and power from the weight of the soft lead.

4 Claims, 3 Drawing Sheets

POLYMER BALLISTIC TIP PELLETS

CROSS REFERENCES

Applicants claim the benefit of the earlier filed Provisional Application No. 60/179,140 filed Jan. 31, 2000.

BACKGROUND OF THE INVENTION

A. Field of the Invention

This invention relates to pellets for use as ammunition in air guns or gas guns.

B. Background

As conventional fire arm type weapons come under political attacks, air guns and gas powered guns are gaining in popularity. While air and gas powered guns have been widely used previously, they have not generally been effective for hunting and harvesting of game. The typical pellet loads in use today are of two types. Solid head pellets, which tend to overpenetrate without imparting a shock to the target. Conversely, the typical hollow point pellets compress too quickly, becoming clogged with animal fur, fat and skin, which tends to cushion against the shock to the adjacent soft tissue.

Other attempts have been made to solve these problems providing pellets made of plastics, resulting in limitations on the range and shock force.

SUMMARY OF THE INVENTION

A polymeric ballistic tip pellet for use as ammunition in an air or gas powered gun is disclosed. The ballistic tip pellet comprises a frusto-conical skirt portion with a hollow tapering cavity, and an annular terminus having maximum diameter complimentary to the inner bore of a gun barrel. A head portion is connected to the skirt portion. Head portion has attached thereto a sharply pointed, conical tip formed from a hard polymeric material which is attached to a base portion intermediate said tip and said skirt portion. A means is provided for attaching the tip to the base portion. Skirt portion is coaxial with the head portion and the tip. The head portion and skirt portion are joined at a plane parallel to the plane of said annular terminus and perpendicular to a longitudinal axis of said pellet; such that when placed inside a hollow bore an air-gun barrel, the skirt portion serves as an air foil to seal an impulse of compressed air or gas between inner bore walls and the compressed air source to propel said pellet in an accurate, high velocity, generally flat trajectory through the discharge end of the gun barrel directed towards a predetermined target.

It is an object of the present invention to provide a pellet for use in an air gun with a hard polymeric tip which does not deform on contact.

Yet another object of the present invention is to provide a pellet for use in an air gun which cleanly penetrates animal fur, fat and skin to impart a shattering force upon contact with bone.

Another object is to provide a pellet for use in an air gun which clears a path for a hollow head of an attached pellet to facilitate delivery of massive shock to bone and tissue.

It is a further object of the present invention to reduce the weight of a pellet while simultaneously increasing the penetrating force delivered to the quarry.

Yet another object of the present invention is to provide an increased range of accuracy and enable a wider target area on an animal.

Another object of the present invention is to provide a variety of pellet configurations, each having a hard polymeric tip for greater penetration and increased force.

DETAILED DESCRIPTION

Figure 1A:
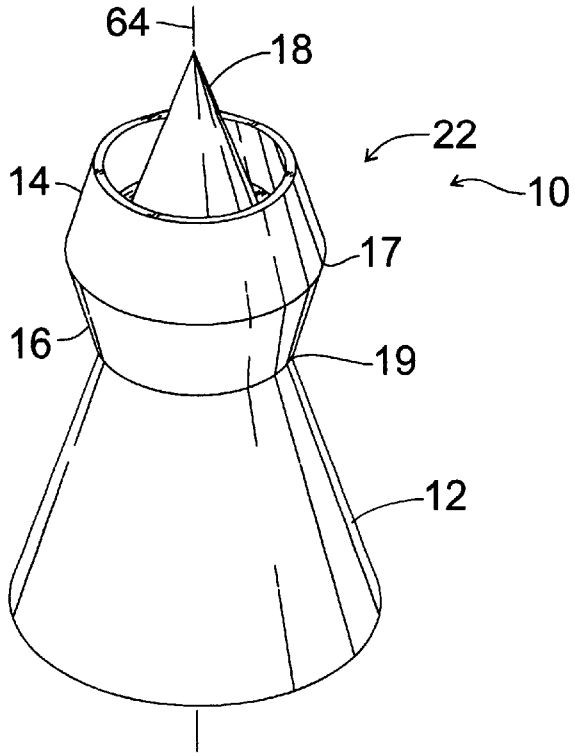
FIG. 1*a* is the perspective view of a hollow head pellet with a polymeric ballistic tip.

Referring first to FIGS. 1(*a*), (*b*) and (*c*), a polymeric ballistic tip pellet is generally designated 10. Pointed tip 18 formed from a hard polymer extends longitudinally from pellet 10 along imaginary axis 64. Top portion 22 is comprised of a pair of frusto-conical sections 14, 16 joined at a co-planer junction defined at their larger diameter and symmetrical about a horizontal plane perpendicular to longitudinal axis 64. Tapered crown 14 extends axially outward toward pointed tip 18, forming cavity 24 between crown 14 inner wall 25, and pointed tip 18. Pointed tip 18 extends longitudinally beyond rim 30 of crown 14, so that when the pellet is fired, tip 18 will make first contact with a target, such as wild game.

Tapering middle portion 16 extends axially in the opposite direction from crown portion 14, tapering inward to junction 19 with skirt portion 12. Skirt portion 12 is also a frusto-conical section, tapering axially outward and away from the tip 18 to a terminal ring 36. Skirt portion 12 has a hollow interior and is open at the distal end adjacent ring 36. The diameter of terminal ring 36 is the maximum diametric dimension of the entire pellet 10. The diameter of terminal ring 36 is complementary to the desired bore of the pellet-air or -gas gun, typically of .25 caliber. The weight, depending on which configuration of the disclosed pellet is used, ranges from 20 to 27 grains in the .25 caliber pellet size. The pellet 10 weight decreases in guns of smaller bores and increases for guns having larger bores.

Cavity 28 is formed by skirt portion 12. Cavity 28 is designed to capture a blast of air or gas directed into the gun barrel when the gun is fired. The pressurized air or gas is scaled between the walls of the gun barrel (not shown) and terminal ring 36, to create a parachute effect in cavity 28 which launches pellet 10 from a gun barrel at a high velocity and flat trajectory.

Figure 1B:
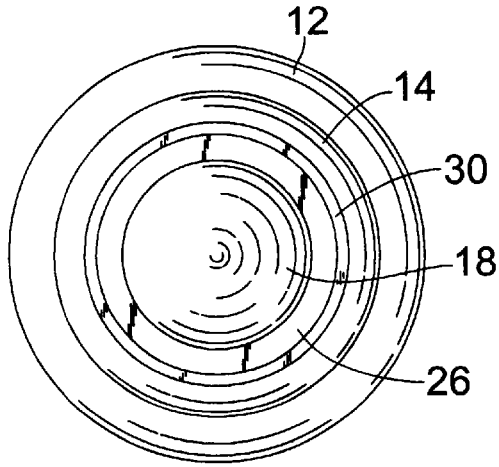
FIG. 1*b* is a top view of the hollow head of pellet of FIG. 1A.

Referring to FIG. 1B, the relative concentric diameters are illustrated in plan view. Pointed tip 18 is supported on shelf 26. Rim 30 is of an intermediate diameter between tip 18 and frusto-conical section 14. Skirt 12 is of maximum diameter relative to all other portions.

Figure 1C:
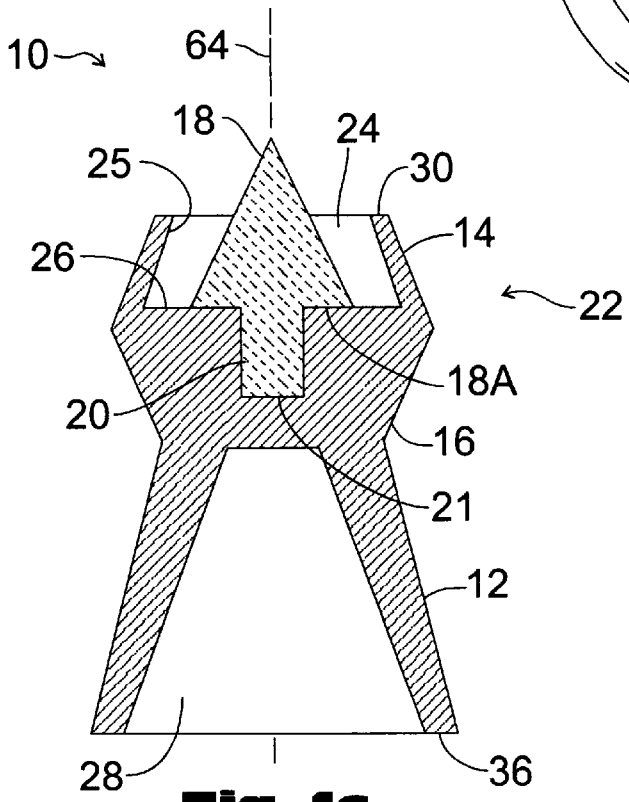
FIG. 1*c* is an elevational view of a section of the hollow head pellet taken through the center of the pellet.

Pointed tip 18 appears as an arrowhead in cross-sectional view in FIG. 1C. Pointed tip 18 has a cylindrical butt end 20 opposite the point. Butt end 20 is of a smaller diameter than the flared portion of tip 18. Butt end 20 extends axially down into a hollow cylindrical recess 21 formed in tapering mid section 16, and is retained there via a friction fit facilitated by precision tolerances. Adhesive or threads may be employed advantageously to permanently secure tip 18 into tapered mid section 16 adjacent shelf 26.

When the pellet 10 is fired from an air gun the polymer tip 18 is the forward most point of pellet 10 and makes contact with the target first. Tip 18 penetrates at least partially into, for example, a small animal, before top portion 22 comes into contact therewith. Top portion 22 is made of soft lead, which is deformable on contact with the quarry. The soft lead material also has greater density than the polymer tip 18. The soft lead top portion 22 deforms and spreads outwardly to form a larger radius as pellet 10 penetrates further into the game animal. Skirt portion 12, also made from soft lead, deforms and spreads as well, imparting additional force through the fur and skin of the animal. Since the hard polymer tip 18 does not deform, it cleanly cuts through the fur, skin and fat layers of the animal with enough force to shatter bone. Tip 18 clears the path for the hollow top portion 22 of the lead pellet 10 and the deformation of the soft lead top portion 22 imparts massive shock into the adjacent soft tissue of the animal.

Figure 2A:
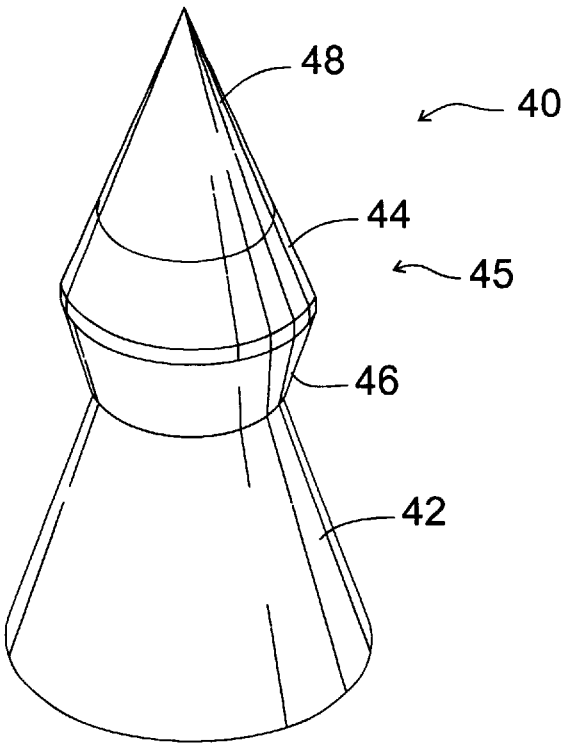
FIG. 2*a* is a perspective view of an alternative embodiment of the pellet with a solid head and polymeric ballistic tip.
Figure 2B:
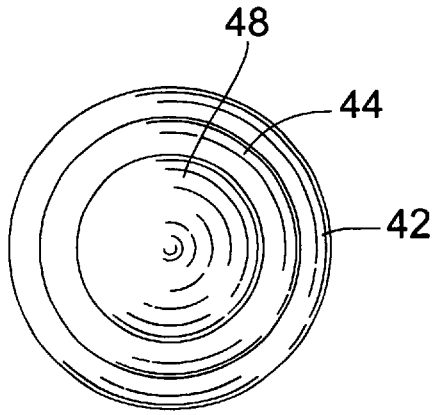
FIG. 2*b* is a top view of the solid head pellet.
Figure 2C:
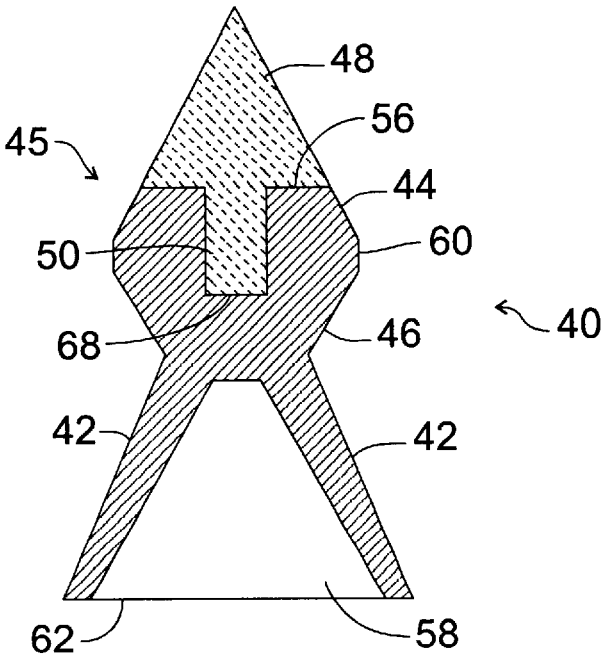
FIG. 2*c* is an elevational section view taken through the center of the solid head pellet.

Referring now to FIGS. 2*a* through 2*c,* an alternative embodiment of the disclosed polymer ballistic tip pellet 40 is illustrated. This configuration of pellet 40 varies from that of FIGS. 1*a–c* in that the head portion 45 does not have a hollow cavity 24 surrounding the tip 48. Head portion 45 is comprised of opposing frusto-conical sections 44, 46, connected by a perimeter band 60. Skirt portions 42 is a hollow, frusto-conical section flaring outwardly to the terminal annulus 62, which defines the maximum radius of the pellet 40. Cavity 58 provides the air foil to capture pressurized air, the propulsion impulse, in the bore of the gun.

The tip portion 48 has a cylindrical butt end 50 which is permanently fixed in cavity 68 of head portion 45. Shelf 56 supports the tip 48 adjacent first frusto-conical section 44.

The end view, as shown in FIG. 2*b,* shows the tip 48 arranged concentrically with first frusto-conical portion 44 and skirt portion 42. Second frusto-conical portion 46 is hidden in this end view.

Figure 3A:
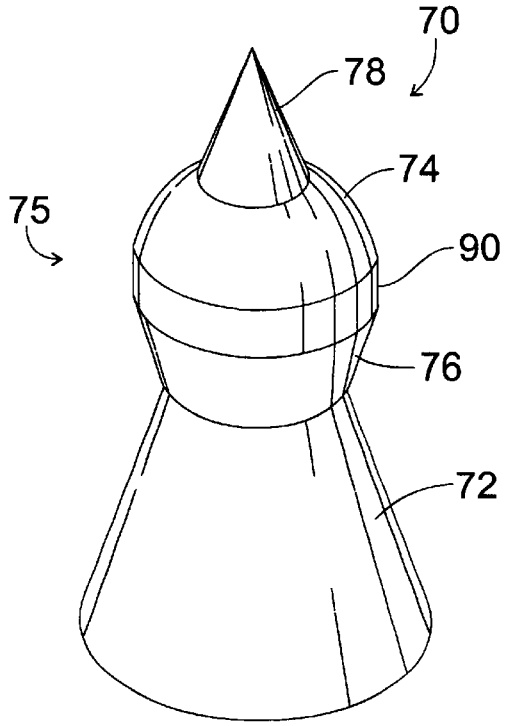
FIG. 3*a* is a perspective view of another alternative embodiment of a pellet having a central cavity and a polymeric ballistic tip.
Figure 3B:
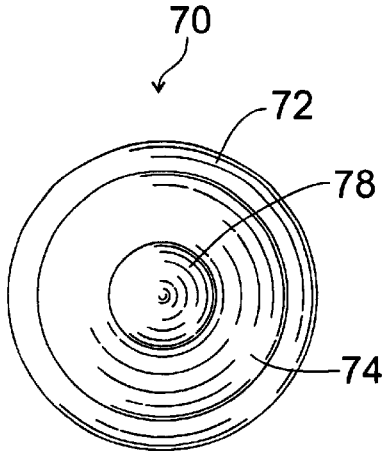
FIG. 3*b* is a top view of the cavity head pellet.
Figure 3C:
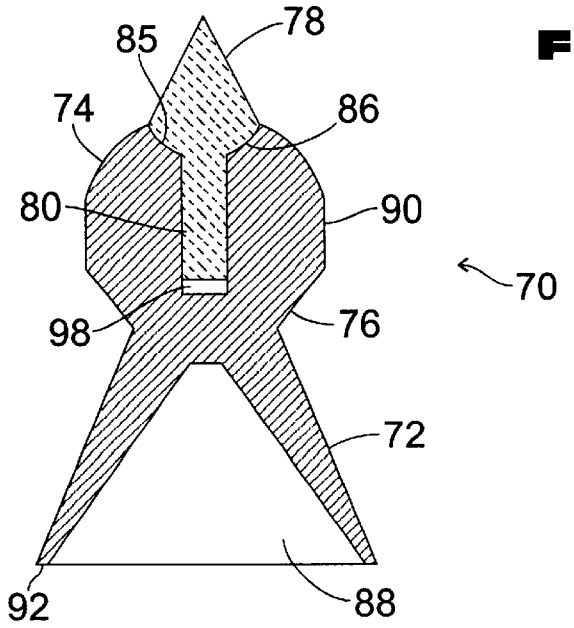
FIG. 3*c* is an elevational section view taken through the center of the cavity head pellet.

Another alternative embodiment employing a polymer ballistic tip 78 in a soft lead pellet 70 is illustrated in FIGS. 3*a*–3*c*. A sharp tip portion 78 is fixedly mounted on head portion 75, which has a dome-shaped first portion 74 adjacent to center band 90, which is in turn connected to frusto-conical portion 76. The tip 78 is conical, terminating in a curved edge 85 which is supported in an arcuately-shaped cup 86. Tip 78 has a cylindrical butt end 80 which is inserted into cavity 98 of head portion 75. Butt end 80 does not extend to the bottom of cavity 98, thereby leaving a hollow chamber into which tip 78 is compressible on contact with a target. Skirt portion 72, similarly to skirts 12, 42, defines hollow recess 88 and terminates at annulus 92 which is the maximum radius of the pellet 70.

In all three configurations, the preferred construction of the pellets 10, 40, 70 is of soft lead, with the exception of the polymeric tip portions 18, 48, 78.

The disclosed configurations are compatible for use in conventional .25 caliber air guns, and may vary in weight from 20 grains to 27 grains in a typical arrangement. The disclosed tips may be varied dimensionally and adapted for use in other air guns of smaller or larger bores, as well as for use in shotgun slugs, muzzle loader slugs and hand gun ammunition. The grain of the pellets will vary correspondingly to an increase or decrease of the gun bore.

The hard tips enable the pellets when fired from an air gun to pierce the fur and skin of small game animals, for example, before the head and skirt portions, made of lead, begin to deform, imparting shock to the surrounding soft tissue, and shattering bone. The disclosed pellets provide both accuracy due to the ballistic tip, and power from the weight of the soft lead.

According to the provisions of patent statutes, I have explained the principle, preferred construction and mode of operation of my invention and have illustrated and described what I now consider to represent its best embodiments. However, it should be understood that within the scope of the appended claims, the invention may be practiced otherwise and as specifically illustrated and described.

We claim:

1. A polymeric ballistic tip pellet for use as ammunition in an air or gas powered gun, comprising:

a forward head portion formed from a deformable metallic material, said head portion having a bottom base opposite a top front-end;

a rearward frusto-conical skirt portion, formed of a deformable metallic material, joined to said head portion at said base, said skirt portion having a hollow tapering cavity coaxial with said head portion extending downward and outward to a bottom annular terminus, said annular terminus having a maximum diameter complimentary to an inner bore of a gun barrel providing a seal therein; and a sharply pointed, solid conical tip formed from a hard polymeric material, said tip being attached to said base of said head portion and protruding forwardly from said front-end, an annular cavity formed in said forward head portion surounding said conical tip, such that said tip enables said pellet to pierce for and skin of small game animals before said head and skirt portions begin to deform, imparting shock to surrounding soft tissue and shattering bone.

2. The polymeric ballistic tip pellet as set forth in claim 1, wherein said head portion having a forward frusto-conical section concentric to said tip, said section extending downward and outward to said base; and said base having a rearward frusto-conical section extending upward and outward from said skirt, abutting said forward frusto-conical section at their respective maximum radius, such that when fired from an air gun, said tip cuts a pilot hole on impact with small game animals allowing said pellet to penetrate deep into tissue delivering a terminable shock effect.

3. The Polymeric ballistic tip pellet as set forth in claim 2, wherein a means for fastening said tip to said base is comprised of a cylindrical shaft attached to said conical tip adjacent said point extending axially into a hollow recess of said base, and retained therein by a frictional fit.

4. The polymeric ballistic tip pellet as set forth in claim 3, wherein said means for fastening also includes an adhesive material applied to the cylindrical shaft.

* * * * *